US011725404B2

(12) United States Patent
Fitzthum

(10) Patent No.: US 11,725,404 B2
(45) **Date of Patent: *Aug. 15, 2023**

(54) FORMWORK PANEL, FORMWORK SYSTEM AND METHOD FOR MOUNTING A TIE ROD

(71) Applicant: DOKA GMBH, Amstetten (AT)

(72) Inventor: Michael Fitzthum, Amstetten (AT)

(73) Assignee: DOKA GMBH, Amstetten (AT)

( * ) Notice: Subject to any disclaimer, the term of this patent is extended or adjusted under 35 U.S.C. 154(b) by 0 days.

This patent is subject to a terminal disclaimer.

(21) Appl. No.: 17/452,196

(22) Filed: Oct. 25, 2021

(65) Prior Publication Data

US 2022/0042330 A1 Feb. 10, 2022

Related U.S. Application Data

(63) Continuation of application No. 16/684,471, filed on Nov. 14, 2019, now Pat. No. 11,199,013.

(30) Foreign Application Priority Data

Nov. 15, 2018 (EP) ..... 18206425

(51) Int. Cl.
*E04G 17/065* (2006.01)

(52) U.S. Cl.
CPC ..... *E04G 17/0657* (2013.01)

(58) Field of Classification Search
None
See application file for complete search history.

(56) References Cited

U.S. PATENT DOCUMENTS 1,168,257 A * 1/1916 Kennedy ..... F16B 13/0808 248/231.21
1,991,256 A * 2/1935 Percival ..... E04G 17/06 249/43

(Continued)

FOREIGN PATENT DOCUMENTS

CH 524037 A 6/1972
CN 205935668 U 2/2017

(Continued)

OTHER PUBLICATIONS

European Patent Office, Extended European Search Report Issued in Application No. 18206425.3, dated May 15, 2019, Germany, 8 pages.

(Continued)

*Primary Examiner* — Joshua K Ihezie
(74) *Attorney, Agent, or Firm* — McCoy Russell LLP

(57) ABSTRACT

A formwork panel including:

a formwork panel member having a front side for delimiting a space to be filled with concrete, a back side opposite the front side and a through-opening extending from the front side to the back side for allowing passage of a tie rod therethrough, the through-opening having a first cross-sectional area;

an adjustment member extending across the through-opening of the formwork panel member, the adjustment member having a through-hole with a second cross-sectional area smaller than the first cross-sectional area of the through-opening of the formwork panel member, the through-hole being moveable relative to the front side of the formwork panel member;

the adjustment member having a disc element with the through-hole formed therein, wherein the disc element (Continued)

covers the through-opening of the formwork panel member except for the through-hole of the disc element.

15 Claims, 8 Drawing Sheets

(56) References Cited

U.S. PATENT DOCUMENTS 2,001,052 A * 5/1935 Colt ..... E04G 17/0742 249/217
2,168,990 A * 8/1939 Hungerford ..... E04G 17/0721 249/46
2,769,333 A * 11/1956 Reintjes ..... E04F 13/0853 52/378
2,916,235 A * 12/1959 Nagel ..... A47G 1/20 248/231.91
3,638,904 A * 2/1972 Franklin ..... E04G 17/0721 249/40
3,785,610 A * 1/1974 Dagiel ..... E04G 17/06 249/217
3,918,673 A * 11/1975 Abbott ..... E04G 17/0721 249/43
3,933,332 A * 1/1976 Lovisa ..... E04G 17/0714 249/43
3,933,333 A * 1/1976 Ellson ..... E04G 17/0714 249/43
3,941,346 A * 3/1976 Franc ..... E04G 17/06 249/40
3,977,647 A * 8/1976 Williams ..... E04G 17/0742 249/191
3,998,424 A * 12/1976 Johnson ..... E04G 17/06 249/40
4,052,032 A * 10/1977 Lovisa ..... E04G 17/0652 249/40
4,085,495 A * 4/1978 Hebert ..... E04G 17/0721 249/46
4,247,073 A * 1/1981 Vario ..... E04G 17/0721 249/46
4,527,768 A * 7/1985 Cohen ..... E04G 17/06 249/190
5,197,567 A * 3/1993 Rabalais ..... F16L 55/1612 220/244
5,702,218 A * 12/1997 Onofrio ..... E04B 9/20 411/341
5,802,795 A * 9/1998 Myers ..... E04G 17/045 52/745.1
7,226,261 B1 * 6/2007 Bristol ..... F16B 13/0808 411/340
7,959,126 B2 * 6/2011 Lee ..... E04G 17/0652 249/40
8,151,425 B2 * 4/2012 Cossart ..... B25B 27/00 29/244
8,661,758 B2 * 3/2014 Longhenry ..... E04G 23/0203 264/46.7
9,222,271 B2 * 12/2015 Amon ..... E04G 17/16
9,580,922 B2 * 2/2017 Hagemes ..... E04G 11/08
10,364,556 B2 * 7/2019 Zavodnick ..... E03C 1/0402
10,480,202 B1 * 11/2019 Colino Vega ..... E04G 11/06
11,199,013 B2 * 12/2021 Fitzthum ..... E04G 17/0657
2009/0000236 A1 * 1/2009 Schlumpf ..... E04G 17/0735 52/699
2010/0059655 A1 3/2010 Schwoerer
2012/0304570 A1 * 12/2012 Braun ..... E04G 17/065 52/705
2013/0074432 A1 * 3/2013 Ciuperca ..... E04B 1/161 52/309.4
2017/0130471 A1 * 5/2017 Huang ..... E04G 11/10

FOREIGN PATENT DOCUMENTS

CN 104806007 B 4/2017
CN 206487144 U 9/2017
DE 19823346 A1 1/1999
DE 19754366 A1 6/1999
EP 3258032 A1 12/2017
EP 3385470 A1 10/2018
FR 2972210 A1 9/2012
JP H0647085 Y2 11/1994

OTHER PUBLICATIONS

IP Austrailia, Examination Report Issued in Application No. 2019264614, dated Nov. 24, 2020, 12 pages.
IP Australia, Examination Report Issued in Application No. 2019264614, dated Mar. 29, 2021, 4 pages.

* cited by examiner

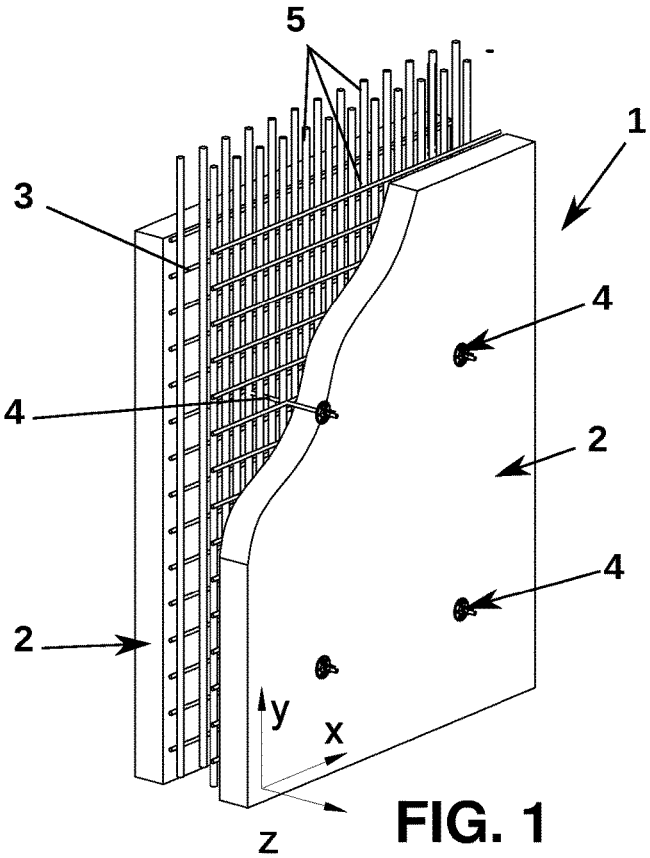
FIG. 1
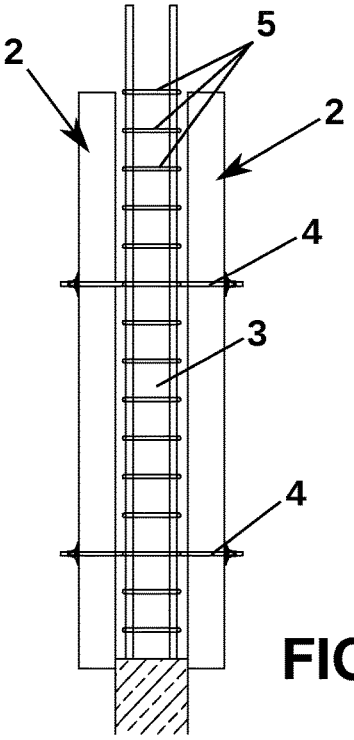
FIG. 2
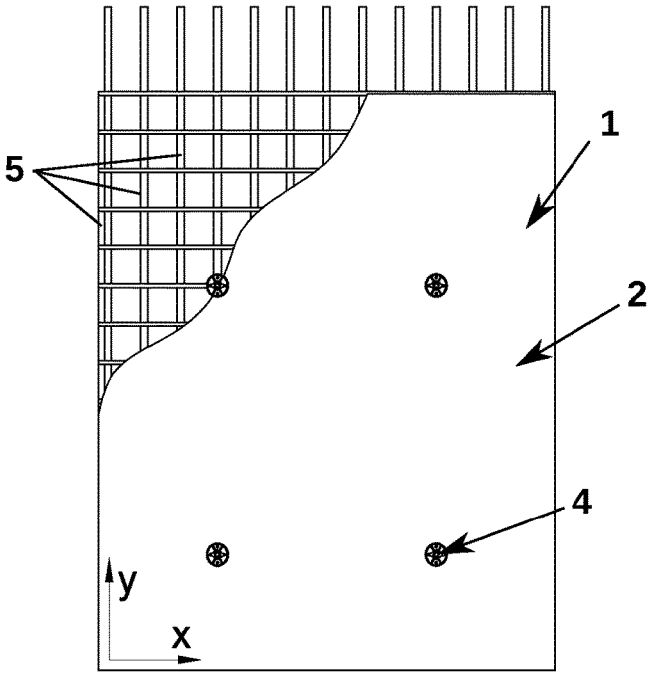
FIG. 3
FIG. 4A
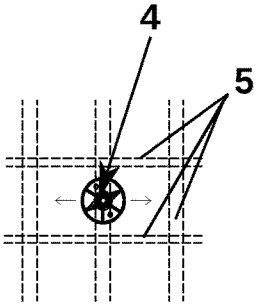
FIG. 4B
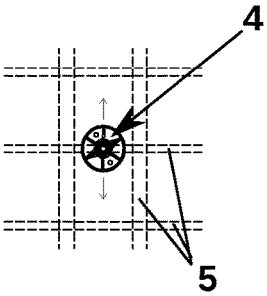
FIG. 4C
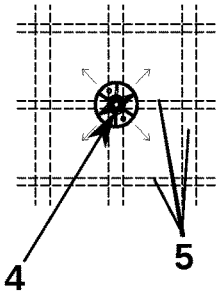

FIG. 19
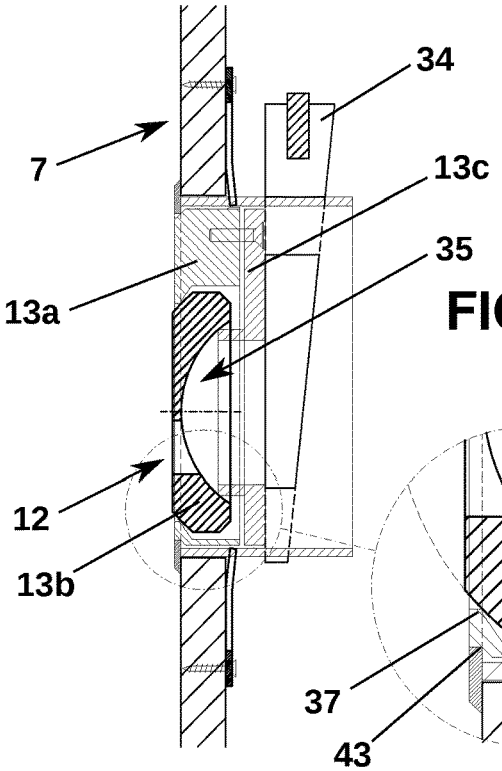
FIG. 20
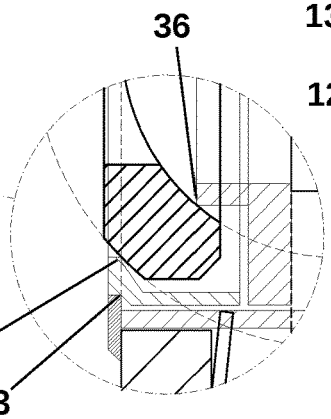
FIG. 21
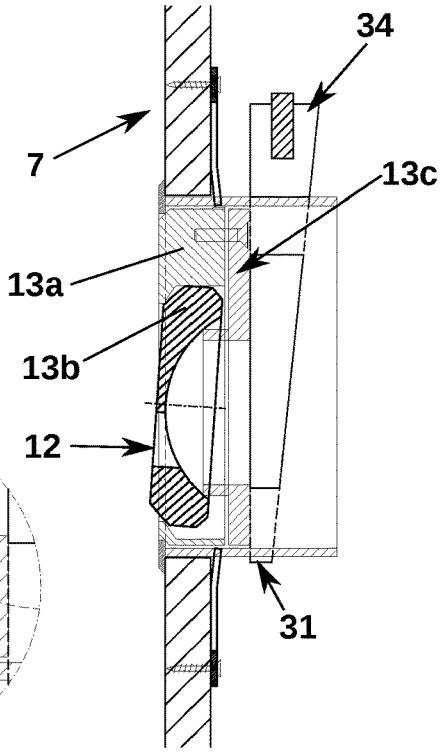
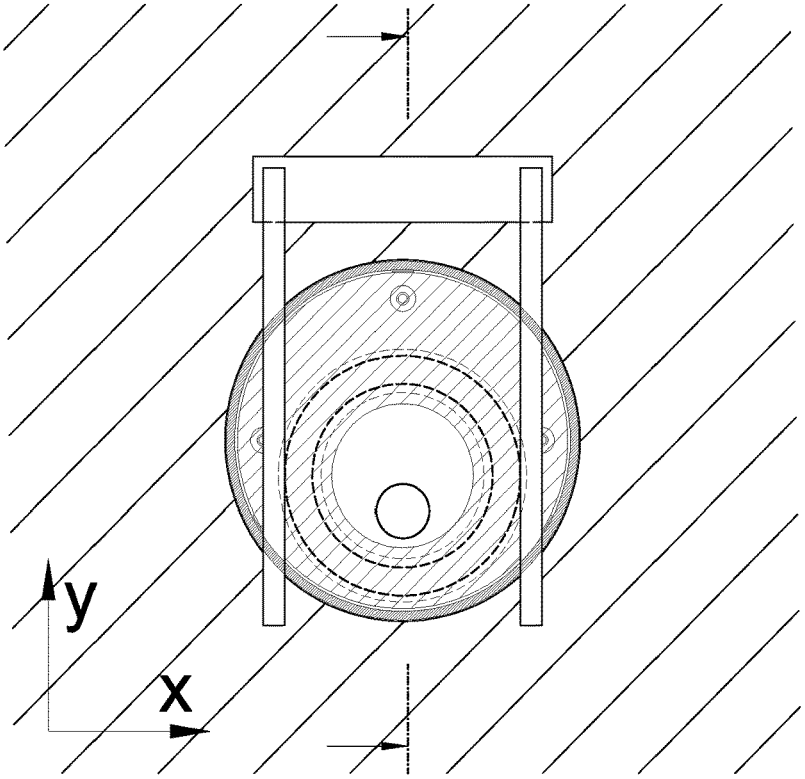
FIG. 22

FORMWORK PANEL, FORMWORK SYSTEM AND METHOD FOR MOUNTING A TIE ROD

CROSS-REFERENCE TO RELATED APPLICATIONS

The present application is a continuation of U.S. Non-Provisional patent application Ser. No. 16/684,471, entitled "FORMWORK PANEL, FORMWORK SYSTEM AND METHOD FOR MOUNTING A TIE ROD", and filed on Nov. 14, 2019. U.S. Non-Provisional patent application Ser. No. 16/684,471 claims priority to European Patent Application No. 18206425.3 filed on Nov. 15, 2018. The entire contents of the above-listed applications are hereby incorporated by reference for all purposes.

TECHNICAL FIELD

The present disclosure relates to a formwork panel comprising a formwork panel member having a front side for delimiting a space to be filled with concrete, a back side opposite the front side and a through-opening extending from the front side to the back side for allowing passage of a tie rod therethrough, the through-opening having a first cross-sectional area.

The present disclosure further relates to a formwork system comprising a formwork panel and a tie rod projecting through the through-hole of the adjustment member.

Furthermore, the present disclosure relates to a method of mounting a tie rod to a formwork panel.

BACKGROUND AND SUMMARY

Such formwork panel is known for example from U.S. Pat. No. 5,160,640. This formwork panel has a face plate which is mounted on a frame made up of structural shapes. The panel is reinforced by a set of spaced, parallel reinforcing beams mounted on the back of the face plate. Additional beams are disposed between selected pairs of reinforcing beams. The additional beams are perpendicular to the reinforcing beams and are spaced from the frame. Each additional beam is provided with an opening which registers with a corresponding opening in the face plate. The registering openings receive tie rods which connect two facing formwork panels to one another so as to define a pouring space for concrete.

On the other hand, US 2010/059655 A1 has recognized as a drawback of known anchor systems that the anchor insertion holes of the form elements facing each other and forming the concrete wall may not be sufficiently well-aligned opposite each other. Because the anchor rod is always inserted from the outside through the already erected form elements, the worker who is positioning the anchor rod cannot see the anchor insertion hole of the opposed form element. With poorly aligned anchor insertion holes, the anchor rod extends obliquely with respect to the formwork shell of the form elements, making it very difficult to engage the thread of a locking device on the rear of the second form element.

Against this background, US 2010/059655 A1 proposes the arrangement of a dome plate that can be fastened to the back of one of the form elements of the concrete wall form. The dome plate has a spherically shaped plate section with an opening, in which the screw nut element is arranged so as to have radial play. The radial play is provided all around so that, within the radial play, deflection of the screw nut element around the entire circumference on the dome plate is possible. In this way, the tie rod may be arranged obliquely with respect to the form elements.

Further formwork panels are known from EP 3 258 032 A1, EP 3 385 470 A1, CH 524 037 A, DE 198 23 346 A1 and FR 2 972 210 A1.

However, this prior art fails to deal with another problem occurring in the erection of the formwork system. Due to reinforcement bars inside the pouring space between the two formwork panels, passage of the tie rod therethrough may be blocked by reinforcement bars. In the prior art, the arrangement of the tie rod is determined by the positions of the insertion holes in the form elements so that avoidance of the reinforcement bars may not be possible.

Thus, it is an object of the disclosure to alleviate or eliminate at least some of the drawbacks of the prior art. The disclosure aims at accommodating for displacements of the tie rod required for avoiding reinforcements arranged in the space to be filled with concrete.

According to the disclosure, the formwork panel has an adjustment member extending across the through-opening of the formwork panel member, the adjustment member having a through-hole with a second cross-sectional area smaller than the first cross-sectional area of the through-opening of the formwork panel member, the through-hole being moveable relative to the front side of the formwork panel member.

According to the disclosure, the formwork system comprises:

a formwork panel as defined above;

a tie rod projecting through the through-hole of the adjustment member.

According to the disclosure, the method of mounting a tie rod to a formwork panel, comprises at least the steps of:

providing a formwork panel member having a front side for delimiting a space to be filled with concrete, a back side opposite the front side and a through-opening extending from the front side to the back side, the through-opening having a first cross-sectional area;

providing an adjustment member to extend across the through-opening of the formwork panel member, the adjustment member having a through-hole with a second cross-sectional area smaller than the first cross-sectional area of the through-opening of the formwork panel member;

moving the through-hole of the adjustment member relative to the front side of the formwork panel member; and passing the tie rod through the through-hole of the adjustment member.

Thus, the through-opening of the formwork panel member is larger in cross-section than the tie rod. To avoid that uncured concrete leaks from the pouring space through the through-opening of the formwork panel member in the presence of the tie rod, the adjustment member is arranged across the through-opening of the formwork panel member. Thus, the adjustment member covers the through-opening of the formwork panel member except for the through-hole of the adjustment member. This through-hole is only slightly larger than the tie rod so that the tie rod may be passed through the through-hole of the adjustment member whereas uncured concrete is prevented from leaking through the formwork panel member. In order to account for a displacement and/or a tilt of the tie rod required for avoiding a reinforcement bar inside the pouring space, the position of the through-hole (i.e. the center of the through-hole) is moveable relative to the front side of the formwork panel member in at least one direction extending parallel to the front side of the formwork panel member. Thus, the through-hole of the adjustment member may be displaced in a direction lying in the main plane of the formwork panel member by manipulating the adjustment member. In an embodiment, the center of the through-hole may be moved by more than 20 mm, or by more than 25 mm, or by at least 30 mm, in each direction with respect to a central position of the through-hole within the through-opening of the formwork panel member. In some embodiments, the size of the through-hole is constant, i.e. not dependent on the position of the through-hole. Thus, the position of the tie rod may be adjusted to avoid a reinforcement bar inside the pouring space by repositioning the through-hole. For instance, two opposed formwork panel members are used to delimit the pouring space, each formwork panel member having an adjustment member with a moveable through-hole as described above. In this case, the tie rod may be horizontally and/or vertically displaced while being maintained in a horizontal position to avoid a reinforcement bar inside the pouring space. Alternatively, the tie rod may be tilted to avoid the reinforcement bar. In distinction to the prior art, the position of the tie rod is not determined by the relative positions of the through-openings in the opposed formwork panel members, but may be adjusted by moving the through-hole within the circumference of the through-opening of the formwork panel member. The movement of the through-hole may be linear or along a curved path. This construction greatly facilitates the anchoring of the tie rod at the formwork panel member. One application is the erection of high-rise buildings in which reinforcements may be densely packed within the pouring space, making it difficult to provide space for installing the tie rods.

In an embodiment, the through-opening of the formwork panel member and the through-hole of the adjustment member are both circular. In this case, the through-opening has a first diameter which is larger than a second diameter of the through-hole of the adjustment member.

For the purpose of this disclosure, all directions and positions, such as "upwards", "downwards", "sidewards", "upper", "lower", "vertical", "horizontal", are given with respect to an intended use of the formwork panel in an upright (vertical) position. It is, however, possible to use the formwork panel in different ways, for example in an inclined or horizontal position, in which case the directions and positions are to be translated accordingly.

In an embodiment, the through-hole of the adjustment member is moveable in all directions parallel to the front side of the formwork panel member. This embodiment allows for a repositioning of the through-hole of the adjustment members in all directions of the main plane of the formwork panel independently of the position of the formwork panel member (or the opposed formwork panel member) delimiting the pouring space. In this way, collisions with reinforcements arranged in the pouring space behind the formwork panel may be easily avoided by shifting and/or tilting the tie rod sideward, upward, downward or any combination thereof. For example, the through-hole may be moved by more than 20 mm, or by more than 25 mm, or by at least 30 mm, in all directions with respect to a central position of the through-hole within the through-opening of the formwork panel member.

In some embodiments, the adjustment member has a disc element with the through-hole formed therein. In this embodiment, the disc element covers the through-opening of the formwork panel member except for the through-hole of the disc element. Thus, the larger through-opening of the formwork panel is reduced to the smaller through-hole of the disc element. By moving the disc element relative to the formwork panel, the through-hole is repositioned within the circumference of the through-opening of the formwork panel to allow for passage of the tie rod. In some embodiments, the disc element is circular.

In an embodiment, the disc element has a third cross-sectional area larger than the first cross-sectional area of the formwork panel member, the disc element being slidably arranged at the front side or back side of the formwork panel member. In this embodiment, the disc element is in sliding contact with the formwork panel member, for example with the front side thereof. For adjusting the position of the through-hole of the adjustment member to the exit position of the tie rod, the disc element is moved along the front or back side of the formwork panel member. In this embodiment, the disc element may be formed by a single disc of circular shape.

In an embodiment, a fastening device with a fastening element secures the adjustment member at a given position of the through-hole with respect to the formwork panel member. For instance, the fastening element is moveable between a release position arranged for installing the adjustment member at the through-opening of the formwork panel member and a fastening position in which the through-hole is secured against an involuntary displacement, such as by gravity. Furthermore, it is advantageous that the fastening element, in the fastening position, presses the disc element against one of the front and back side of the formwork panel member, thereby preventing the leaking of uncured concrete therebetween. This variant is advantageous when using a wooden formwork panel member which is prone to shrinking or swelling.

A variety of fastening elements may be used to secure the adjustment member in the desired position. In some variants, the fastening element is a wedge or a leaf spring.

If the fastening element is a wedge, it is advantageous that the fastening device has a fastening flange, the fastening flange extending transversely to the disc element, the wedge being connected to the fastening flange.

If the fastening element is a leaf spring, it is advantageous that the leaf spring has two leaf spring arms each resting against the back side of the formwork panel member.

In some embodiments, it is advantageous that the spring force of the leaf spring is adjustable. For this purpose, the fastening device may have a support plate for supporting a support section of the leaf spring thereon, the support section of the leaf spring having a plurality of openings spaced in a longitudinal direction of the leaf spring, at least one adjustment screw being passed through one of the plurality of openings and connected to the support plate. Thus, the spring force may be adjusted by relocating the adjustment screw from one opening to another.

In an embodiment, the fastening element, in a state of the adjustment member demounted from the formwork panel member, is undetachably, but linearly moveably and tiltably connected to the disc element. This allows for insertion of the fastening element in a tilted and linearly displaced position through the through-opening of the formwork panel member. In a state of the adjustment member mounted on the formwork panel member, the fastening element is blocked against linear movement and tilting with respect to the disc element. This construction facilitates the mounting of the adjustment member to the formwork panel member. For this purpose, first, the adjustment member is provided detached, i.e. separate from, the formwork panel member. Second, the fastening element is arranged in its tilted (inclined) and linearly displaced position which allows for the introduction of one end of the fastening element through the through-opening of the formwork panel member. Third, the fastening element is tilted backwards and linearly displaced in the opposite direction to arrange the fastening element in its fastening position for securing the disc element against the formwork panel member. For instance, the fastening element, in the state mounted and fastened at the formwork panel member is arranged in an upright position.

In another embodiment, the disc element has a first disc and a second disc, the first disc being rotatably arranged in the through-opening of the formwork panel member, the second disc being rotatably arranged in a receiving opening of the first disc, the second disc having the through-hole for passing the tie rod therethrough.

For displacing the through-hole in accordance with the arrangement of the tie rod, the receiving opening can be eccentrically arranged at the first disc and/or that the through-hole is eccentrically arranged at the second disc. Due to the eccentric arrangement of the receiving opening, a rotation of the first disc about its central axis (perpendicular to the main plane of the first disc) displaces the through hole formed in the second disc along a first curved path. In the same fashion, the eccentric arrangement of the through-hole at the second disc has the effect that a rotation of the second disc about its central axis (perpendicular to the main plane of the second disc) displaces the through-hole along a second curved path. For instance, both the receiving opening of the first disc and the through-hole of the second disc are eccentric so that a combination of rotations of the first and second disc places the through-hole at any desired position inside the circumference of the through-opening of the formwork panel member.

In a preferred embodiment, the disc element has a third disc fixed to the first disc and securing the second disc to the first disc. In this embodiment, the second disc is rotatably arranged between the first and third disc. The arrangement of the third disc prevents an involuntary removal of the second disc from the first disc. For this purpose, the third disc may have an opening slightly smaller than the second disc so that a peripheral region of the second disc is axially secured by means of the third disc.

In some embodiments, the first disc has a projection engaging a corresponding circumferential recess of the second disc to block an axial movement of the second disc with respect to the first disc in a first direction. The second disc can be secured against axial movement with respect to the first disc in a second, opposite direction by means of the third disc, as explained above.

In an embodiment, a lock, such as a wedge element, secures the disc element to the formwork panel member, the lock being arranged at the back side of the formwork panel member.

In an embodiment, a frame is mounted at the through-opening of the formwork panel member, the disc element being connected to the frame by means of the lock. For example, the disc element is connected to the frame only after the tie rod has been passed through the through-opening of the formwork panel member. This variant is simple as the large through-opening of the formwork panel member may be used for passing the tie rod therethrough. Then, the disc element is put over the end of the tie rod. By rotating the first and/or second disc the position of the through-hole is adjusted to conform with the exit position of the tie rod. Then, the disc element is secured at the through-opening by means of the lock, which, for example, may be arranged in a locking opening of the frame previously arranged at the through-opening of the formwork panel member.

In an embodiment, the frame or the first disc has a first sealing edge for a linear sealing contact with a first contact area of the other of the frame and the first disc. For instance, the first disc or the second disc has a second sealing edge for a linear sealing contact with a second contact area of the other of the first disc and the second disc. This reduces malfunctions due to dirt or leaked concrete.

In an embodiment, the second disc is tiltable with respect to the first disc. By allowing a tilt (or inclination) of the second disc, the adjustment member allows for greater angles of the tie rod. For instance, the second disc is tiltable in all directions to account for a sideward, upward or downward tilt of the tie rod or a combination thereof.

In this embodiment it is advantageous that the second disc, at its back side, has a spherical indentation and, at its front side, has a spherical surface, the adjustment member having a first edge for a linear contact with the spherical indentation of the second disc, the adjustment member having a second edge for a linear contact with the spherical surface of the second disc, the spherical indentation and the spherical surface of the second disc having the same center point. In this way, a leak of concrete is prevented while allowing for a tilt of the second disc. Due to the linear contact, this construction is reliable and less prone to malfunctions caused by remnants of concrete.

In a first variant of the method of mounting the tie rod to the formwork panel, the steps of providing an adjustment member to extend across the first cross-sectional area of the through-opening of the formwork panel member, the adjustment member having a through-hole with a second cross-sectional area smaller than the first cross-sectional area of the through-opening of the formwork panel member;

moving the through-hole of the adjustment member relative to the front side of the formwork panel; and passing the tie rod through the through-hole of the adjustment member are performed in the given order. Thus, the sequence of steps is as follows. First, the adjustment member is mounted at the formwork panel member to restrict the through-opening formed therein to the through-hole of the adjustment member. Next, the adjustment member is moved to relocate the through-hole so as to correspond to the desired position of the tie rod. Then, the tie rod is passed through the through-hole of the adjustment member.

In another variant, which can be used in connection with the first and second disc discussed above, the sequence of the steps is different. In this case, the method has at least the following steps performed subsequently:

passing the tie rod through the through-opening of the formwork panel member while the adjustment member is detached from the formwork panel member;

passing the tie rod through the through-hole of the adjustment member while the adjustment member is still detached from the formwork panel member; and providing the adjustment member to extend across the first cross-sectional area of the through-opening of the formwork panel member.

Before or after passing the tie rod through the through-hole of the adjustment member, the through-hole of the adjustment member is moved relative to the front side of the formwork panel. Finally, the adjustment member may be locked in place by means of the lock.

This variant has the advantage that the tie rod may be easily passed through the through-opening of the formwork panel member in the absence of the adjustment member which is only mounted to the through-opening thereafter.

BRIEF DESCRIPTION OF FIGURES

The disclosure will be further explained with respect to exemplary embodiments shown in the drawings.

FIGS. 1 to 3 show a formwork system having two opposed formwork panels arranged in horizontal distance to one another to define a pouring space to be filled with concrete, a number of tie rods connecting the two formwork panels as well as an arrangement of reinforcement bars inside the pouring space between the formwork panels.

FIGS. 4A to 4C schematically illustrate a number of situations in which the tie rod would collide with one of the reinforcement bars placed between the formwork panel members, requiring a displacement of the tie rod to avoid such collision.

FIGS. 19 to 22 show a fourth embodiment of the adjustment member in a state mounted to the through-opening of the formwork panel member.

DETAILED DESCRIPTION

Figure 5A:
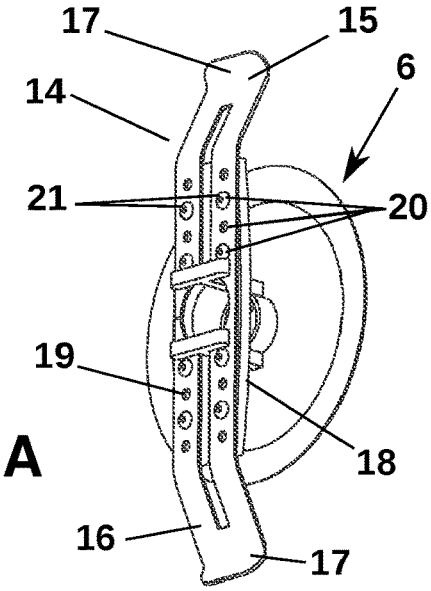
FIG. 5A and FIG. 5B show a first embodiment of an adjustment member to be arranged in a through-opening of one of the formwork panel members.
Figure 5B:
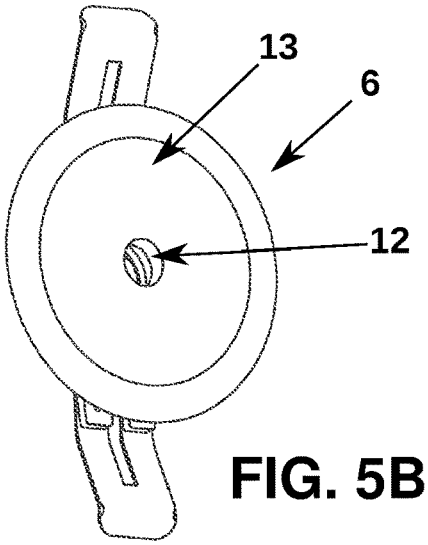
Figure 7:
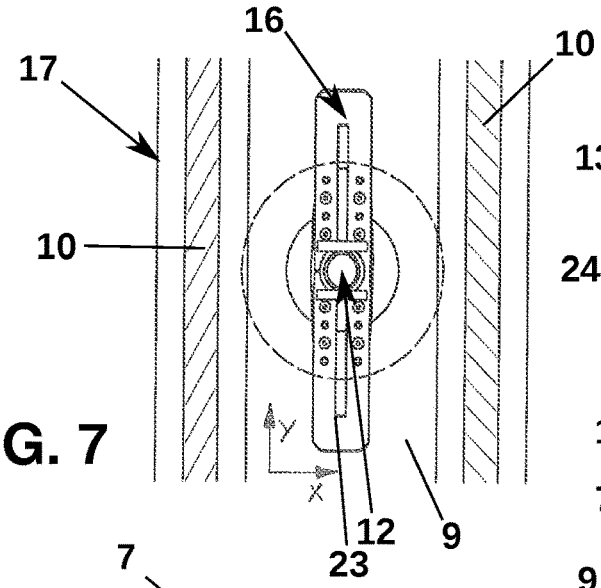
FIG. 7 is a sectional view along lines VII-VII in FIG. 6.
Figure 6:
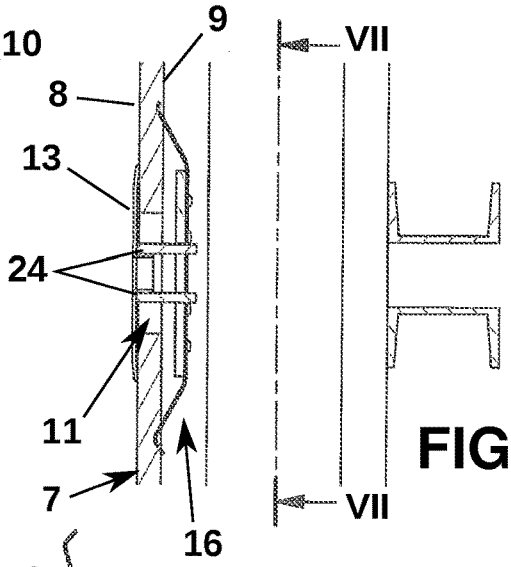
FIG. 6 shows the adjustment member of FIGS. 5A, 5B in a state mounted to the through-opening of the formwork panel member.

FIGS. 1 to 3 show a formwork system 1 with two formwork panels 2 arranged in a horizontal distance from one another to define a space 3 to be filled with concrete for forming a wall element. The two formwork panels 2 are connected by means of tie rods (or anchor rods) 4 which are passed transversely to the formwork panels 2 through the space 3. Inside the pouring space 3, a plurality of steel reinforcement bars 5 are placed. Both vertical and horizontal reinforcement bars 5 may be used. For example, in the construction of high-rise buildings, reinforcements 5 are densely packed in pouring space 3.

FIGS. 4A to 4C illustrate that the tie rod 4 may collide with one of reinforcements 5 if restricted to a specific position. To avoid this problem, the tie rod 4 may be displaced sideward (i.e. horizontally), as shown in FIG. 4A; or upwards or downwards (see FIG. 4B); or a combination thereof (see FIG. 4C).

To allow such repositioning of the tie rod 4, formwork system 1 comprises at least one adjustment member 6 connected to at least one of the formwork panels 2. In the shown example, the formwork panel 2 has a formwork panel member 7 with a planar front side 8 facing the pouring space 3 to be filled with concrete, a planar back side 9 opposite the front side 8 and beams 10 projecting backwards from back side 9 of formwork panel member 7. A through-opening 11 extends from the front side to the back side for allowing passage of the tie rod 4 therethrough. In the shown embodiment, the through-opening 11 is circular with a first diameter, which may be at least 50 mm, or at least 70 mm, or at least 90 mm, or at least 100 mm.

In a state mounted to the formwork panel member 7, the adjustment member 6 extends across the first diameter of through-opening 11 of formwork panel member 7. Adjustment member 6 has a circular through-hole 12 extending from the front side 8 to the back side 9 of the formwork panel member 7. In the shown embodiment, the through-hole 12 is circular with a second diameter which is smaller than the first diameter of the through-opening 11 of the formwork panel member 7. For adjusting the position of the through-hole 12 to the desired position of the tie rod 4, the through-hole 12 is moveable relative to the formwork panel member 7. In the shown example, the through-hole 12 is moveable in all directions so that the tie rod 4 between the two opposed formwork panel members 7 may be displaced and/or tilted sideward, upward/downward or any combination thereof. In the shown embodiment, the through-hole 12 may be displaced by more than 20 mm, or by more than 25 mm, or by at least 30 mm, in all directions with respect to a central position of the through-hole 12 inside the through-opening 11 of the formwork panel member 7. Thus, in total the through-hole 12 is moveable by at least 40 mm horizontally and vertically.

In the embodiment shown in FIGS. 5A, 5B, 6, and 7, the adjustment member 6 has a disc element 13 with the through-hole 12 arranged centrally therein. Thus, the disc element 13 covers the through-opening 11 of the formwork panel member 7 except for the through-hole 12 of the disc element 13. The disc element 13 has a third diameter larger than the first diameter of the through-opening 11 of the formwork panel member 7 so that the disc element 13 is slidably arranged at the front side 8 of the formwork panel member 7. For keeping the disc element 13 in tight contact with the front side 8 of the formwork panel member 7, a fastening device 14 with a fastening element 15 is arranged at the back side 9 of the formwork panel member 7. The fastening element 15 is arranged for securing the adjustment member 6 at any position of the through-hole 12 with respect to the formwork panel member 7. The fastening element 15 is connected to the disc element 13 and with this connection the movement of the adjustment member 6 is limited to ensure that the through-opening 11 remains closed at all times to avoid leaking of concrete and an inadvertent detachment of the adjustment member 6. In the shown example, the fastening element 15 is a leaf spring 16 with two leaf spring arms 17 each pressed against the back side 9 of the formwork panel member 7. The fastening device 14 has a support plate 18 for supporting a support section 19 of the leaf spring 16 thereon. The support section 19 of the leaf spring 16 has a plurality of pairs of openings 20 spaced in a longitudinal direction of the leaf spring 16 and aligned with corresponding openings of the support plate 18. Adjustment screws 21 are passed through one of the plurality of pairs of openings 20 and connected to the support plate 18. Thus, the spring force may be adjusted by relocating one of the pairs of the adjustment screws 21 from one pair of openings 20 to another.

In a state of the adjustment member 6 separate from the formwork panel member 7, the leaf spring 16 is undetachable from disc element 13, but slideable and tiltable with respect to the disc element 13. For this purpose, the leaf spring 16 has a longitudinal slot 23 that allows for a downward and upward movement of the leaf spring 16 with respect to the disc element 13. Furthermore, the leaf spring 16 is horizontally moveable on horizontal flanges 24 connected to the disc element 13. Thus, when detached from formwork panel member 7, the leaf spring 16 may both be tilted and moved upwards/downwards with respect to the disc element 13. This facilitates the mounting of the adjustment member 6 at the through-opening 11 of the formwork panel member 7, as will be explained below.

Figure 8A:
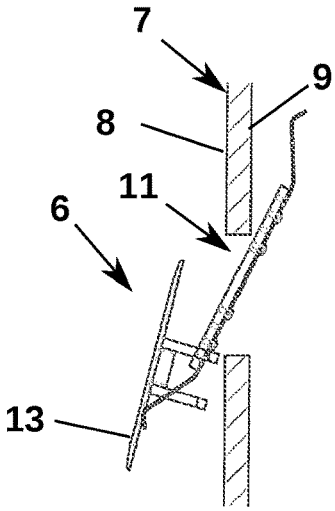
FIGS. 8A to 8C is a sequence of sectional views illustrating the mounting of the adjustment member of FIG. 5A to FIG. 7 at the through-opening of the formwork panel member.
Figure 8B:
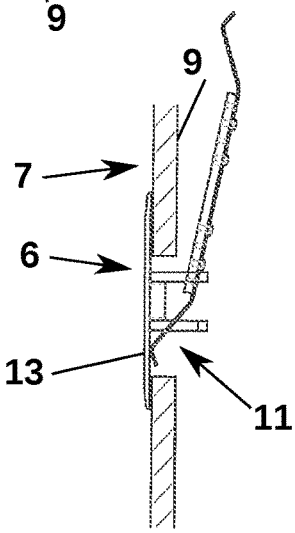
Figure 8C:
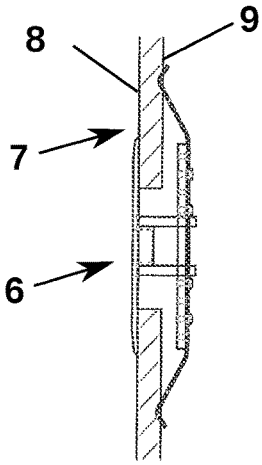

FIGS. 8A-8C show the attachment of the adjustment member 6 at the through-opening 11 of the formwork panel member 7.

In a first step, the adjustment member 6 is provided demounted from the formwork panel member 7. In this state, the fastening element 15 is tilted and moved upwards so that the fastening element 15 may be inserted through the through-opening 11 of the formwork panel member 7 (see FIG. 8A).

Then, the disc element 13 may be brought in abutment with the formwork panel member 7 (see FIG. 8B).

As soon as disc element 13 is in place, the fastening element 15 is pivoted backwards and slid downwards into its upright mounted state, in which the disc element 13 is pressed against the front side 8 of the formwork panel member 7 (see FIG. 8C).

Figure 9A:
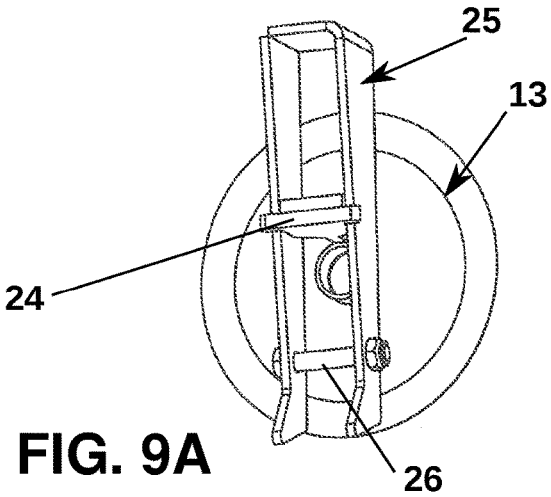
FIGS. 9A, 9B show a second embodiment of an adjustment member to be arranged in the through-opening of the formwork panel member.
Figure 9B:
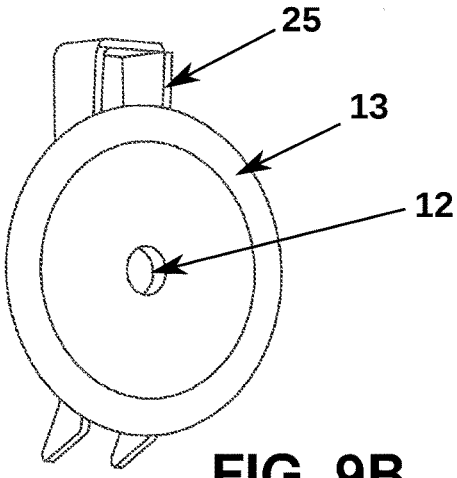
Figure 10:
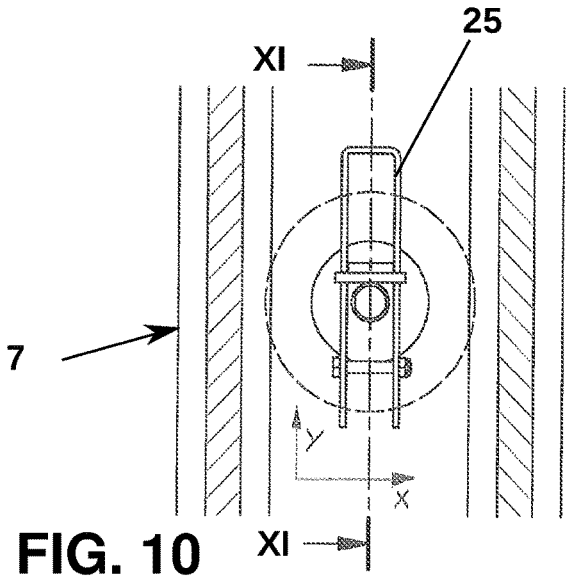
FIG. 10 shows the adjustment member of FIGS. 9A, 9B in a state mounted to the through-opening of the formwork panel member.
Figure 11:
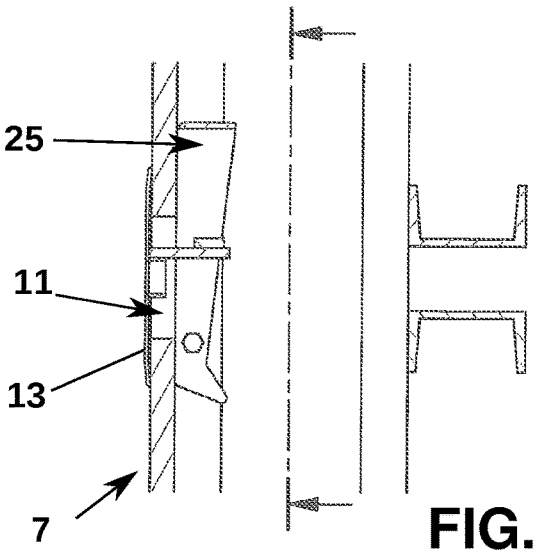
FIG. 11 is a sectional view along lines XI-XI in FIG. 10.

FIG. 9A and FIG. 9B show the adjustment member 6 with a different embodiment of the fastening element 15 which, in this case, is a wedge 25 cooperating with the flange 24 projecting from the disc element 13. The wedge 25 has a transverse element 26 which prevents an involuntary detachment of the wedge 25 from the disc element 13. By moving the wedge 25 downwards against the flange 24 the wedge 25 is blocked at the back side 9 of the formwork panel member 7 so that the disc element 13 is pressed against the front side 8 of the formwork panel member 7 (see FIGS. 10, 11).

Figure 12A:
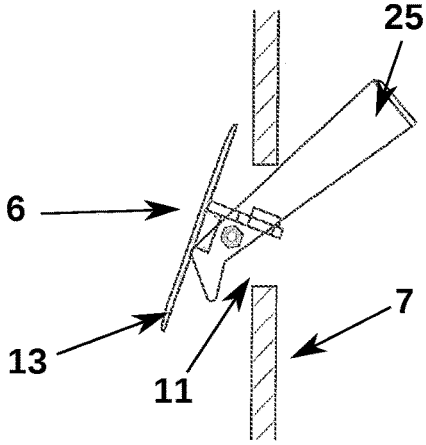
FIGS. 12A to 12C is a sequence of sectional views illustrating the mounting of the adjustment member of FIGS. 9A, 9B, 10 and 11 at the through-opening of the formwork panel member.
Figure 12B:
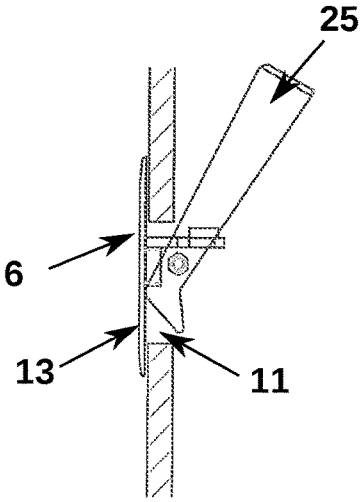
Figure 12C:
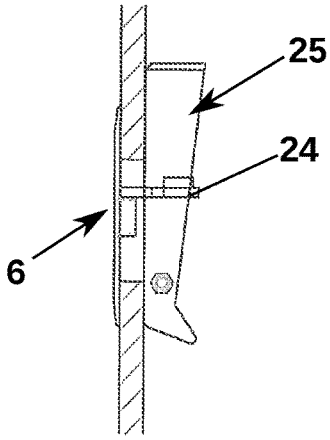
Figure 13A:
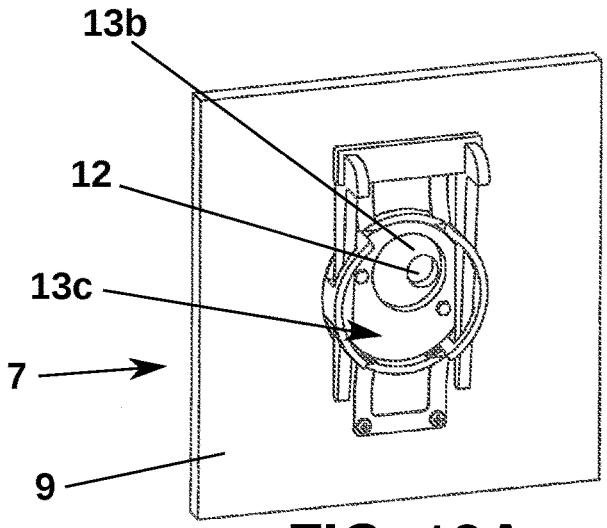
FIGS. 13A, 13B show a third embodiment of an adjustment member to be arranged in the through-opening of the formwork panel member.
Figure 13B:
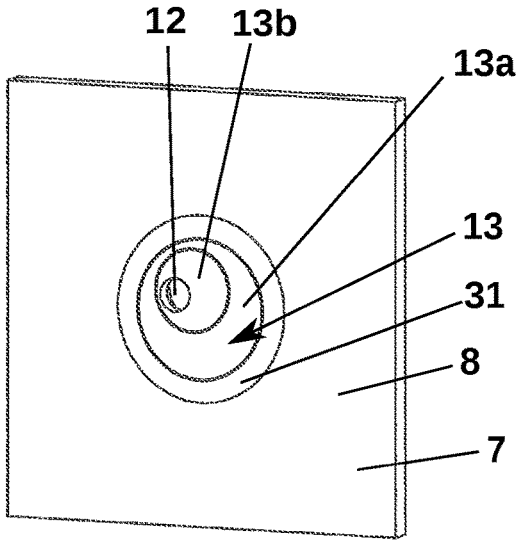
Figure 14:
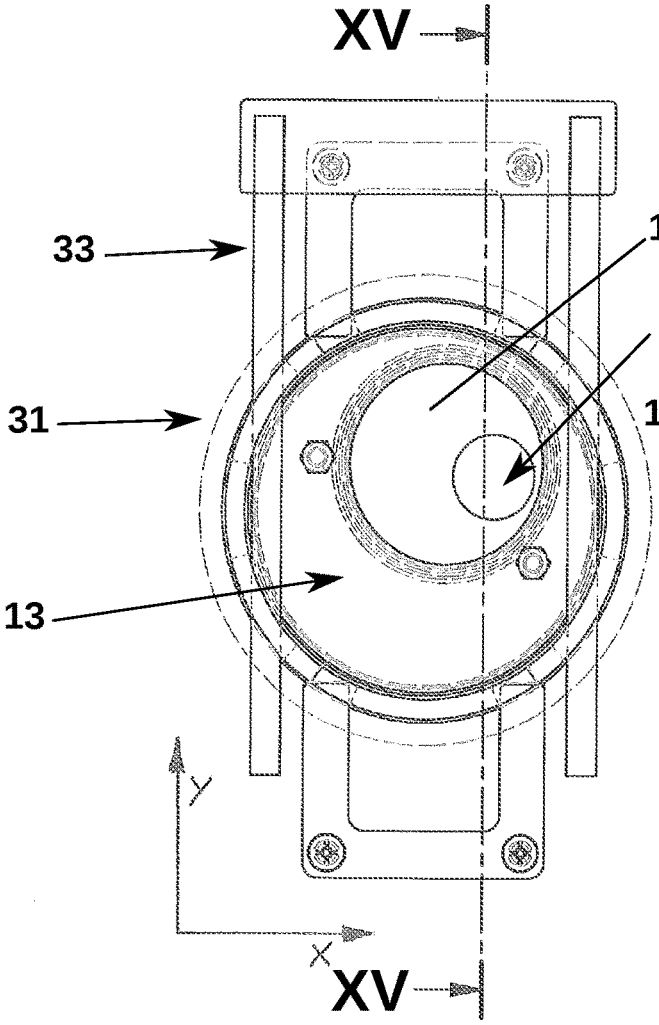
FIG. 14 shows the adjustment member of FIGS. 9A, 9B in a state mounted to the through-opening of the formwork panel member.
Figure 15:
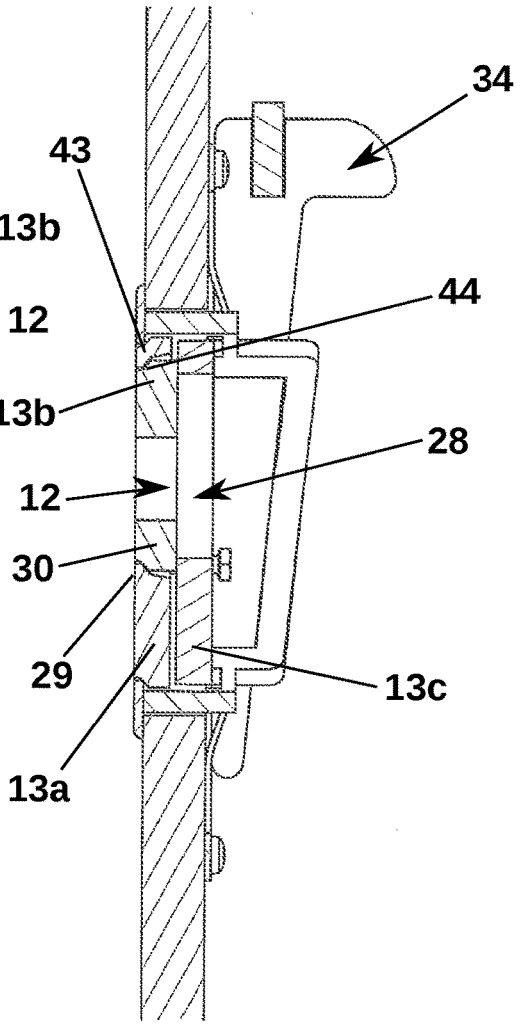
FIG. 15 is a sectional view along lines XV-XV in FIG. 14.
Figure 16:
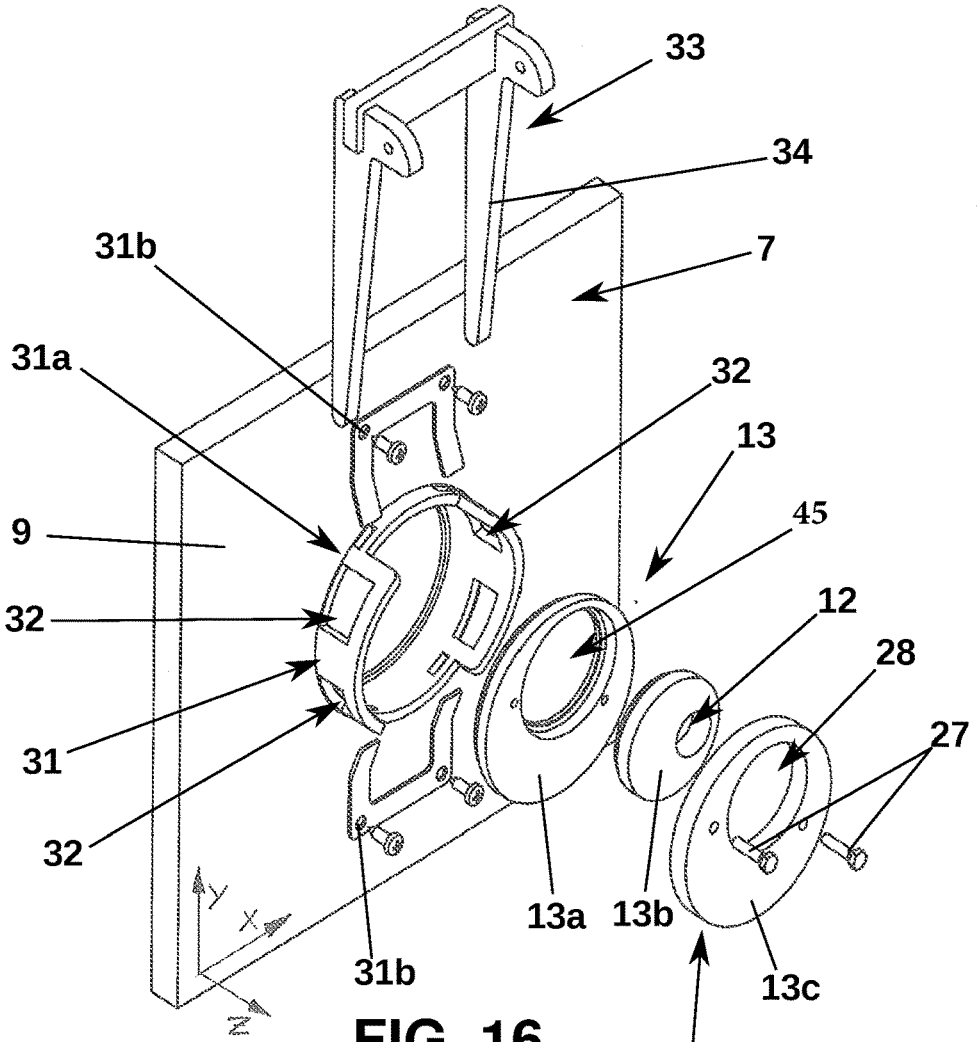
FIG. 16 is an exploded view of the adjustment member of FIGS. 14, 15.

As can be seen from FIGS. 12A to 12C, the mounting of adjustment member 6 at the through-opening 11 by means of the wedge 25 is done in the same fashion as in the embodiment shown in FIGS. 8A to 8C. First, the wedge 25 is tilted and moved upwards to allow for the insertion of the wedge 25 into the through-opening 11 (see FIG. 12A). In this position, the disc element 13 may be brought in contact with the front side 8 of the formwork panel 7 surrounding the through-opening 11 (see FIG. 12B). As soon as the disc element 13 is in place, the wedge 25 is moved downwards to be blocked at the back side 9 of the formwork panel member 7 (see FIG. 12C).

In the embodiment shown in FIGS. 13A, 13B, 14, 15 and 16, the disc element 13 has a first disc 13*a* and a second disc 13*b*. The first disc 13*a* is rotatably arranged in the through-opening 11 of the formwork panel member 7. The second disc 13*b* is rotatably arranged in a receiving opening 45 (see FIG. 16) of the first disc 13*a*. The second disc 13*b* has the through-hole 12 for passing tie rod 4 therethrough. The receiving opening 45 is eccentrically arranged within the circumference of the first disc 13*a*. In the same way, the through-hole 12 is eccentrically arranged within the circumference of the second disc 13*b*. The disc element 13 has a third disc 13*c* fixed to the first disc 13*a*, for example by means of screws 27 (see FIG. 16) to secure the second disc 13*b* to the first disc 13*a*. In this embodiment, the second disc 13*b* is rotatably arranged between the first disc 13*a* and the third disc 13*c*. The arrangement of the third disc 13*c* prevents an involuntary removal of the second disc 13*b* from the first disc 13*a*. The third disc 13*c* is also used to hold all components of disc element 13 together by using a single wedge element 34 (see below), in any position of the discs. The third disc 13*c* has a through opening 28 slightly smaller in diameter than the second disc 13*b* so that a peripheral region of the second disc 13*b* is axially secured by means of third disc 13*c*. Furthermore, the first disc 13*a* has a circumferential projection 29 engaging a corresponding circumferential recess 30 of second disc 13*b* to block an axial movement of the second disc 13*b* with respect to the first disc 13*a* in direction of the pouring space 3.

In the shown embodiment, a frame 31 for disc element 13 is mounted at the through-opening 11 of the formwork panel member 7. The frame 31 has a hollow cylindrical insert 31*a* fitted into the through-opening 11 and fastening members 31*b* attached to the back side 9 of formwork panel member 7. At cylindrical member 31*a*, the frame 31 has attachment openings 32 for inserting a lock 33, here with a wedge element 34, which, in the locked state shown in FIGS. 13A, 13B, 14 and 15, holds the disc element 13 in place.

In the shown embodiment, the frame 31 has a first sealing edge 43 for a linear sealing contact with the first disc. The first disc 13*a* has a second sealing edge 44 for a linear sealing contact with the second disc 13*b*.

Figures 17A, 17B, 17C:
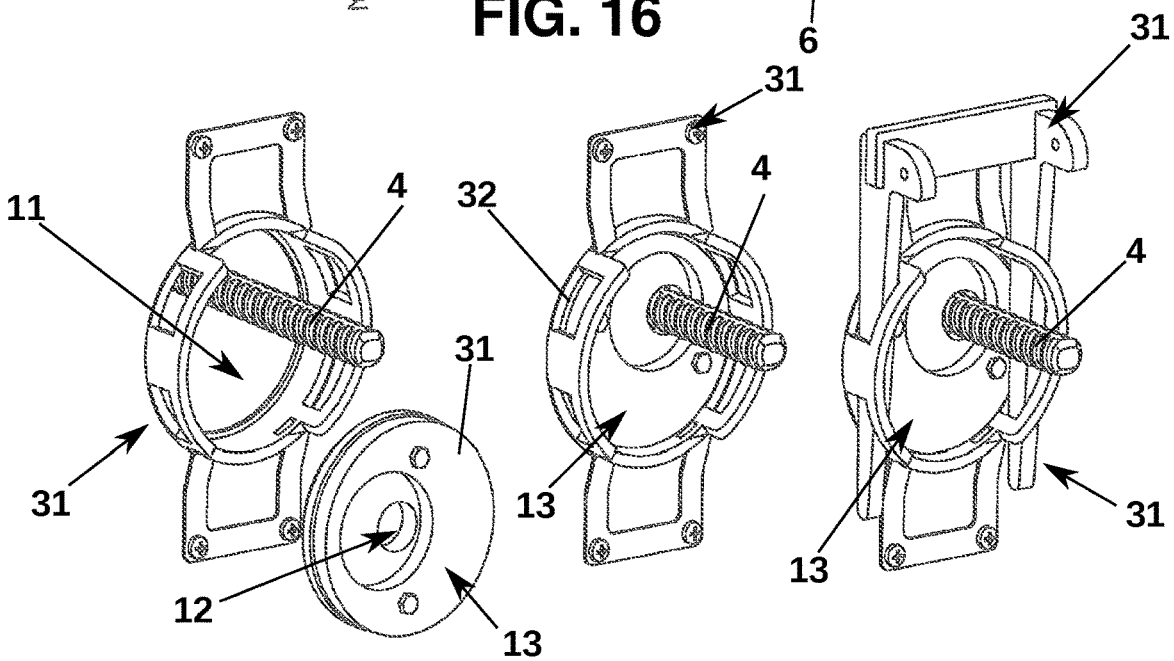
FIGS. 17A to 17C is a sequence of views illustrating the mounting of the adjustment member of FIGS. 13A, 13B, 14 and 15 at the through-opening of the formwork panel member.
Figure 18A:
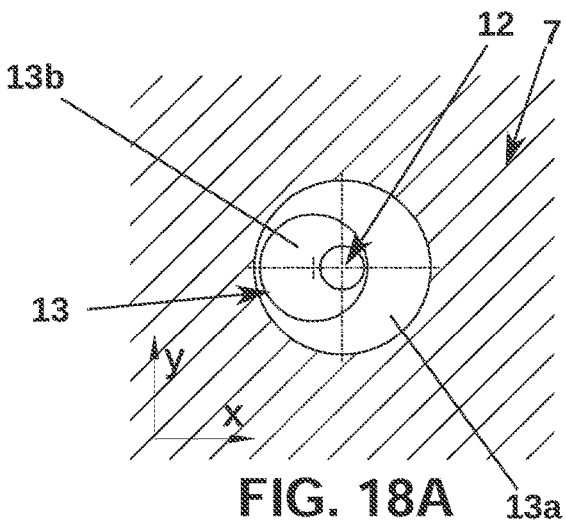
FIGS. 18A to 18E show the adjustment member of FIGS. 13A to 17C in different states adjusted to the arrangement of the tie rod.
Figure 18B:
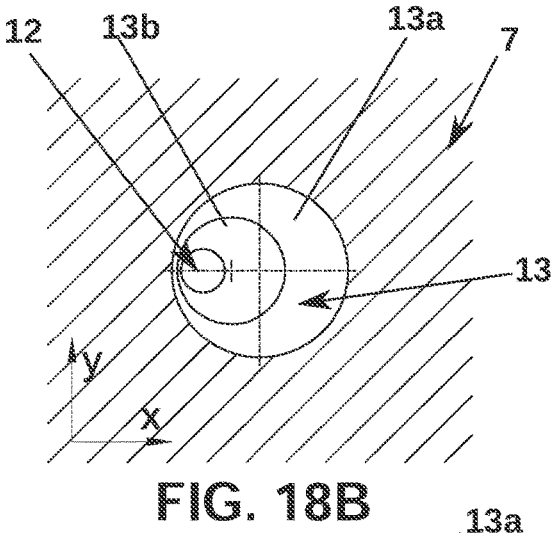
Figure 18C:
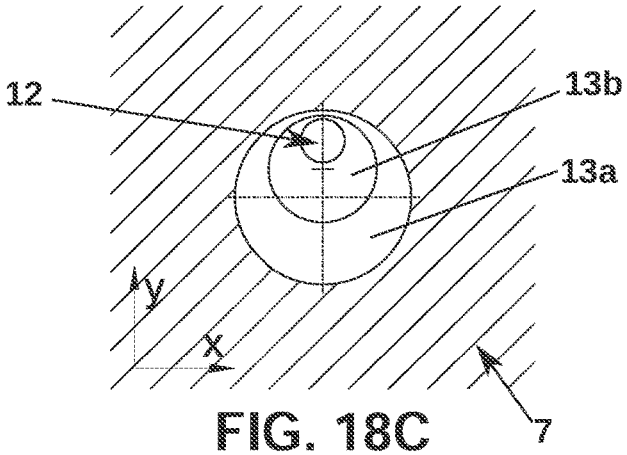
Figure 18D:
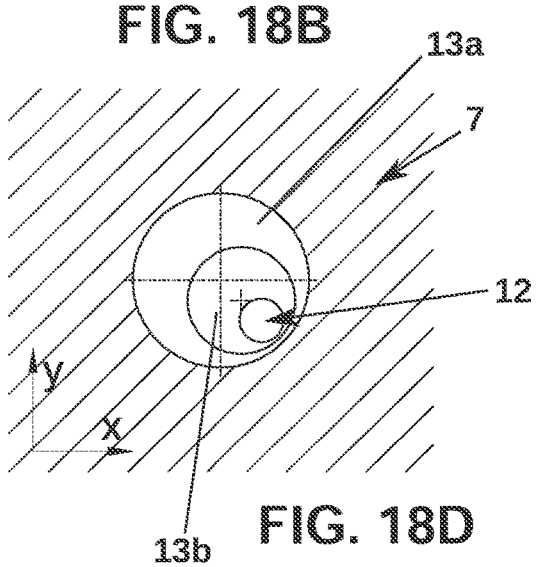
Figure 18E:
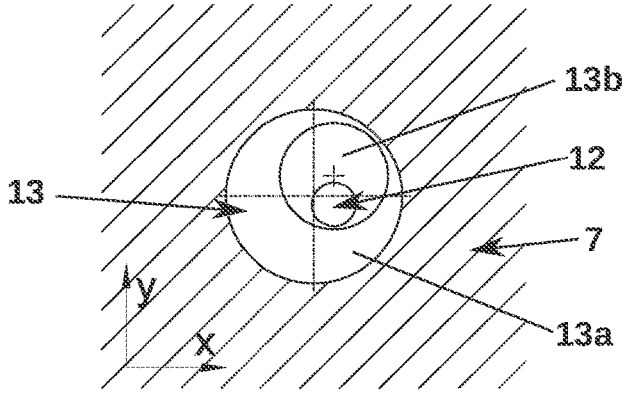

FIGS. 17A to 17C illustrate the arrangement of the tie rod 4 in the disc element 13 having the first disc element 13*a*, the second disc element 13*b* and the third disc element 13*c*.

First, tie rod 4 is passed through hollow cylindrical member 31*a* of the frame 31 while the disc element 13 is detached from the formwork panel member 7 (see FIG. 17A).

Second, the tie rod 4 is passed through the through-hole 12 of the second disc 13*b* while the disc element 13 is still detached from the formwork panel member 7.

Third, the through-hole 12 of the disc element 13 is moved relative to the formwork panel member 7 for adjusting the position of the through-hole 12 to the desired position of the tie rod 4. To this end, the first disc 13*a* and/or the second disc 13*b* are rotated depending on the position of the tie rod 4.

Fourth, with the through-hole 12 in the correct position, the disc element 13 is put in place inside the frame 31 to fill out the through-opening 11 of the formwork panel member 7.

Fifth, the disc element 13 is secured by means of the wedge element 34.

FIGS. 19 to 22 show a variant of the embodiment illustrated in FIGS. 13A to 18. Not all parts are shown in all drawings.

In this embodiment, the second disc 13*b* is tiltable with respect to first disc 13*a*. Thus, the second disc 13*b* may be tilted forward, backward, upward/downward (or a combination thereof) with respect to an upright position extending parallel to the front side 8 of the formwork panel member 7. As can best be seen in the detailed view of FIG. 20, the adjustment member 6 has a first circumferential edge 36 for a linear contact with a spherical indentation 35 at the back side of second disc 13*b*. The adjustment member 6 further has a second circumferential edge 37 for a linear contact with a spherical surface at the front side of the second disc 13*b*. The spherical indentation 35 at the back side and the spherical surface at the front side have the same center point to allow for the tilting of the second disc 13*b*.

Figure 23:
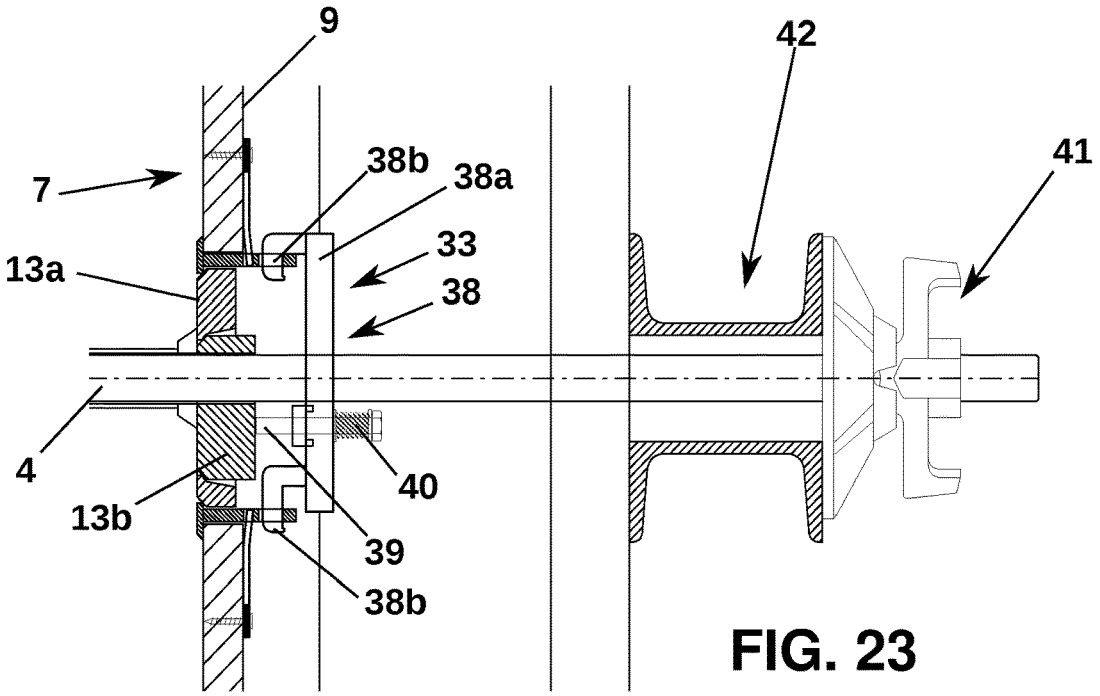
FIG. 23 and FIG. 24 show a fifth embodiment of the adjustment member in a state mounted to the through-opening of the formwork panel member.
Figure 24:
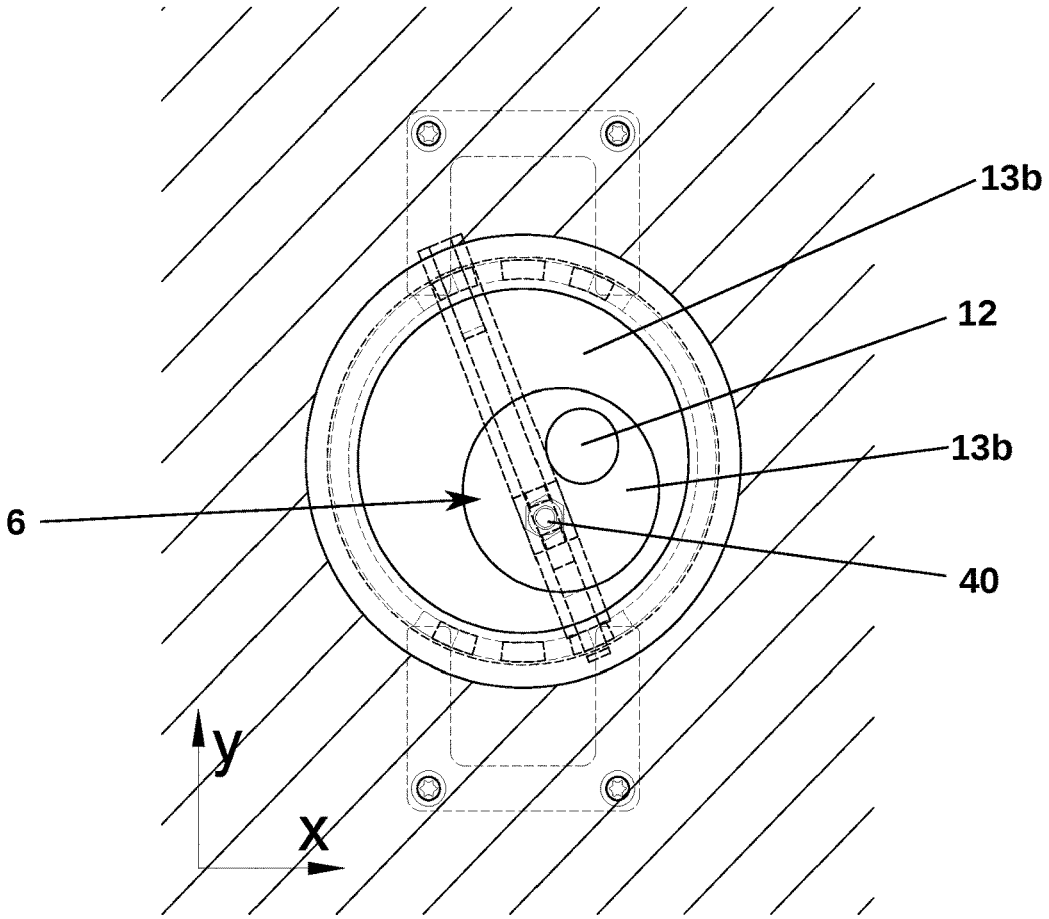

FIGS. 23, 24 show another variant of the embodiment of FIGS. 13A to 17C.

In this embodiment, the lock 33 has a clamping tool 38 with a rail 38*a* having hooks 38*b* for connection with the frame 31. A clamping screw 39 is mounted on the rail 38*a*. By tightening the screw 39, the disc element 13 is secured to the formwork panel member 7. A spring 40 holds the tightening screw 39 in position before the screw 39 is tightened.

FIGS. 23, 24 also show the tensioning of the tie rod 4 projecting through a waling 42 of the formwork panel 2 by means of a screw nut 41.

The invention claimed is:

1. A formwork panel comprising:

a formwork panel member having a front side for delimiting a space to be filled with concrete, a back side opposite the front side and a through-opening extending from the front side to the back side for allowing passage of a tie rod therethrough, the through-opening having a first cross-sectional area;

an adjustment member extending across the through-opening of the formwork panel member, the adjustment member having a through-hole with a second cross-sectional area smaller than the first cross-sectional area of the through-opening of the formwork panel member, the through-hole being moveable relative to the front side of the formwork panel member, the through-hole being displaceable in a direction lying in a main plane of the formwork panel member; and wherein the adjustment member has a disc element with the through-hole formed therein, wherein the disc element covers the through-opening of the formwork panel member except for the through-hole of the disc element.

2. The formwork panel according to claim 1, wherein the through-hole of the adjustment member is moveable in all directions parallel to the front side of the formwork panel member.

3. The formwork panel according to claim 2, wherein the disc element has a third cross-sectional area larger than the first cross-sectional area of the formwork panel member, the disc element being slidably arranged at the front side or back side of the formwork panel member.

4. The formwork panel according to claim 1, further comprising a fastening device with a fastening element for securing the adjustment member at a given position of the through-hole with respect to the formwork panel member.

5. The formwork panel according to claim 4, wherein the fastening element is a wedge or a leaf spring.

6. The formwork panel according to claim 4, wherein the fastening element, in a state of the adjustment member demounted from the formwork panel member, is undetachably, but linearly moveably and tiltably connected to the disc element.

7. The formwork panel according to claim 1, wherein the disc element has a first disc and a second disc, the first disc being rotatably arranged in the through-opening of the formwork panel member, the second disc being rotatably arranged in a receiving opening of the first disc, the second disc having the through-hole for passing the tie rod therethrough.

8. The formwork panel according to claim 7, wherein the receiving opening is eccentrically arranged at the first disc and/or the through-hole is eccentrically arranged at the second disc.

9. The formwork panel according to claim 8, wherein the disc element has a third disc fixed to the first disc and securing the second disc to the first disc.

10. The formwork panel according to claim 7, further comprising a lock for securing the disc element to the formwork panel member.

11. The formwork panel according to claim 7, wherein the second disc is tiltable with respect to the first disc.

12. The formwork panel according to claim 11, wherein the second disc, at its back side, has a spherical indentation and, at its front side, has a spherical surface, the adjustment member having a first edge for a linear contact with the spherical indentation of the second disc, the adjustment member having a second edge for a linear contact with the spherical surface of the second disc, the spherical indentation and the spherical surface of the second disc having a same center point.

13. The formwork panel according to claim 10, wherein the lock is a wedge element.

14. A formwork system comprising:

the formwork panel according to claim 1; and the tie rod projecting through the through-hole of the adjustment member.

15. A method of mounting a tie rod to a formwork panel, comprising:

providing a formwork panel member having a front side for delimiting a space to be filled with concrete, a back side opposite the front side and a through-opening extending from the front side to the back side, the through-opening having a first cross-sectional area;

providing an adjustment member to extend across the through-opening of the formwork panel member, the adjustment member having a through-hole with a second cross-sectional area smaller than the first cross-sectional area of the through-opening of the formwork panel member, the through-hole being displaceable in a direction lying in a main plane of the formwork panel member, wherein the adjustment member has a disc element with the through-hole formed therein, wherein the disc element covers the through-opening of the formwork panel member except for the through-hole of the disc element;

moving the through-hole of the adjustment member relative to the front side of the formwork panel member; and passing the tie rod through the through-hole of the adjustment member.

* * * * *